US012286845B2

(12) United States Patent
Farley et al.

(10) Patent No.: US 12,286,845 B2
(45) Date of Patent: Apr. 29, 2025

(54) SLIMLINE STOP COLLAR WITH SEAL TO PREVENT MICRO-ANNULUS LEAKAGE

(71) Applicant: DOWNHOLE PRODUCTS LIMITED, Aberdeen (GB)

(72) Inventors: Douglas Farley, Missouri City, TX (US); Darko Arsoski, Angus (GB)

(73) Assignee: DOWNHOLE PRODUCTS LIMITED

( * ) Notice: Subject to any disclaimer, the term of this patent is extended or adjusted under 35 U.S.C. 154(b) by 0 days.

(21) Appl. No.: 18/729,345

(22) PCT Filed: Jan. 18, 2023

(86) PCT No.: PCT/IB2023/050424
§ 371 (c)(1),
(2) Date: Jul. 16, 2024

(87) PCT Pub. No.: WO2023/209442
PCT Pub. Date: Nov. 2, 2023

(65) Prior Publication Data

US 2025/0092743 A1 Mar. 20, 2025

Related U.S. Application Data

(60) Provisional application No. 63/334,889, filed on Apr. 26, 2022.

(51) Int. Cl.
*E21B 17/10* (2006.01)
*E21B 7/02* (2006.01)
(Continued)

(52) U.S. Cl.
CPC ..... *E21B 17/1078* (2013.01); *E21B 7/024* (2013.01); *E21B 10/30* (2013.01); *E21B 33/129* (2013.01)

(58) Field of Classification Search
CPC ..... E21B 17/1078; E21B 17/10; E21B 7/024; E21B 10/30; E21B 33/129
See application file for complete search history.

(56) References Cited

U.S. PATENT DOCUMENTS 2,824,613 A * 2/1958 Baker ..... E21B 17/1028 166/241.7
3,799,277 A 3/1974 Kellner
(Continued)

OTHER PUBLICATIONS

Egypt Oil & Gas, Cement Seal units eliminates the inter-zonal communication, https://egyptoil-gas.com/features.cement-seal-units-elimates-the-inter-zonal-communication/, Dec. 29, 2014, 6 pages.
(Continued)

*Primary Examiner* — Yong-Suk (Philip) Ro

(57) ABSTRACT

A stop collar for mounting to a downhole tubular includes: a cylindrical housing having a threaded inner surface and a tapered inner surface; a compressible slip ring having teeth formed in an inner surface thereof and a pair of tapered outer surfaces; a cam ring having a tapered inner surface; a seal receivable in the housing; a cylindrical bolt having a threaded outer surface. A natural outer diameter of each ring is greater than a minor diameter of the threaded surfaces. Screwing the threaded surfaces of the housing and the bolt is operable to drive the tapered surfaces together and compress the seal, thereby compressing the slip ring such that the teeth engage a periphery of the tubular and energizing the seal into engagement with the periphery of the tubular.

9 Claims, 6 Drawing Sheets

(51) Int. Cl.
*E21B 10/30* (2006.01)
*E21B 33/129* (2006.01)

(56) References Cited

U.S. PATENT DOCUMENTS 4,105,262 A * 8/1978 Richey ..... E21B 17/1078 175/325.2
4,384,626 A 5/1983 Derouin
4,438,822 A * 3/1984 Russell ..... E21B 17/1078 175/325.5
4,600,063 A * 7/1986 Beasley ..... F16D 1/05 175/325.5
8,752,638 B2 6/2014 Nutley
9,359,860 B2 6/2016 Hallundbæk
9,816,344 B2 * 11/2017 Roselier ..... E21B 33/10
9,920,412 B2 3/2018 Scott
9,963,952 B2 5/2018 Hallundbæk
10,202,819 B2 2/2019 Hallundbæk
10,364,638 B2 7/2019 Hallundbæk
10,385,637 B2 8/2019 Marr
2003/0006609 A1 * 1/2003 Yates ..... F16L 37/0915 285/39
2007/0284037 A1 12/2007 Buytaert
2012/0073834 A1 3/2012 Lembcke
2020/0109607 A1 4/2020 Mackay
2021/0148176 A1 * 5/2021 Kellner ..... E21B 23/03
2021/0285292 A1 * 9/2021 Arsoski ..... E21B 17/1028

OTHER PUBLICATIONS

Weatherford, Micro-Seal™ Isolation System-Bow (MSIS-B), weatherford.com, 2009-2011, 2 pages.
Weatherford, Micro-Seal™ Isolation System-Unit (MSIS-U), weatherford.com, 2009-2011, 2 pages.
Zerocor Green Solutions, Flint-Coat, zerocor.com, 2021, 2 pages.

* cited by examiner

SLIMLINE STOP COLLAR WITH SEAL TO PREVENT MICRO-ANNULUS LEAKAGE

BACKGROUND OF THE DISCLOSURE

Field of the Disclosure

The present disclosure generally relates to a slimline stop collar with a seal to prevent micro-annulus leakage.

Description of the Related Art

U.S. Pat. No. 3,799,277 discloses a force applicator including a mandrel to be connected to a rotary drilling machine, a piston on the mandrel, a cylinder around the piston, a spline connecting the mandrel and cylinder, and two earth bore engageable releasable anchor means, one of the anchor means being connected to the mandrel and the other to the cylinder. The mandrel is tubular to supply pressure fluid to the drilling machine and to the piston and cylinder for applying axial force to the mandrel. Suitable control means enables the operator to release the mandrel anchor means and set the cylinder anchor means and apply pressure fluid to the outer face of the piston to press the mandrel in toward the end of the hole being drilled or apply pressure fluid to the inner face of the piston to withdraw the mandrel from the hole; or to release the cylinder anchor means and set the mandrel anchor means and apply pressure fluid to the inner head of the cylinder to move the cylinder towards the end of the hole or apply pressure fluid to the outer head of the cylinder to move the cylinder out of the hole.

U.S. Pat. No. 4,384,626 discloses a clamp-on stabilizer which fixes the lateral position of a drill string in a borehole. The stabilizer includes a gripping sleeve with slotted and tapered ends, a stabilizer body receiving the sleeve, and a tubular locknut threaded into the body. The lower end of the stabilizer body is internally tapered to engage one tapered end of the gripping sleeve, while a ring abutting the locknut engages the other tapered end. In a preferred embodiment the tapers are different at each end of the sleeve to produce a sequential locking effect. A full-length longitudinal slot in the sleeve increases the tolerance range for objects to be clamped by the stabilizer.

U.S. Pat. No. 8,752,638 discloses a downhole apparatus, for example a centralizer, including a swellable material which expands upon contact with at least one predetermined fluid. In a first aspect of the invention, a centralizer comprises a body and a plurality of formations upstanding from the body. In another aspect, a downhole apparatus comprises a throughbore configured to receive a tubular, a swellable member, and a rigid assembly integrally formed with the swellable member. The rigid assembly provides stand off to the apparatus in use. In a further aspect, the downhole apparatus has a first condition before expansion of the swellable member in which a rigid assembly defines a maximum outer diameter of the apparatus. In a second condition after expansion of the swellable member, the swellable member defines a maximum outer diameter of the apparatus. In a preferred embodiment, the rigid assembly is designed to flex or deform under an axial or radial load.

U.S. Pat. No. 9,359,860 discloses an annular barrier for being expanded in an annulus between a well tubular structure and an inside wall of a borehole downhole. The annular barrier includes a tubular part for mounting as part of the well tubular structure; an expandable sleeve made of a first metal, surrounding the tubular part and defining a space being in fluid communication with an inside of the tubular part, the expandable sleeve having a longitudinal extension, an inner face facing the tubular part and two ends; a connection part made of a second metal, connecting the expandable sleeve with the tubular part; an opening for letting fluid into the space to expand the sleeve, and a transition area comprising a connection of the sleeve with the connection part.

U.S. Pat. No. 9,920,412 discloses a composition, method for depositing the composition on a downhole component, and a downhole tool. The composition includes about 0.25 wt % to about 1.25 wt % of carbon, about 1.0 wt % to about 3.5 wt % of manganese, about 0.1 wt % to about 1.4 wt % of silicon, about 1.0 wt % to about 3.0 wt % of nickel, about 0.0 to about 2.0 wt % of molybdenum, about 0.7 wt % to about 2.5 wt % of aluminum, about 1.0 wt % to about 2.7 wt % of vanadium, about 1.5 wt % to about 3.0 wt % of titanium, about 0.0 wt % to about 6.0 wt % of niobium, about 3.5 wt % to about 5.5 wt % of boron, about 0.0 wt % to about 10.0 wt % tungsten, and a balance of iron.

U.S. Pat. No. 9,963,952 discloses a downhole annular barrier with an axial extension having an outer surface facing an inner surface of an outer structure has a tubular part, an expandable part, and at least one annular sealing element. The annular sealing element is connected with the expandable part and has an axial length along the axial extension of the downhole annular barrier which is less than 50% of a length of the downhole annular barrier along the axial extension of the downhole annular barrier. The annular sealing element has a spring element U.S. Pat. No. 10,202,819 discloses an annular barrier system for expanding an annular barrier in an annulus between a well tubular structure and an inside wall of a borehole downhole including an annular barrier having a tubular part for mounting as part of the well tubular structure. The annular barrier further includes an expandable sleeve surrounding the tubular part, at least one end of the expandable sleeve being fastened in a fastener of a connection part in the tubular part. The annular barrier system also has a tool for expanding the expandable sleeve by letting a pressurized fluid through a passage in the tubular part into a space between the expandable sleeve and the tubular part.

U.S. Pat. No. 10,364,638 discloses an annular barrier to be expanded in an annulus between a well tubular structure and an inside wall of a borehole downhole. The annular barrier includes a tubular part for mounting as part of the well tubular structure, an expandable sleeve surrounding the tubular part and having an inner face facing the tubular part, each end of the expandable sleeve being connected with a connection part which is connected with the tubular part, a space between the inner face of the sleeve and the tubular part, and an element arranged in connection with the sleeve, the element having a first part and a second part both of which extend around the inner face, the first part of the element being fastened to the inner face.

U.S. Pat. No. 10,385,637 discloses a stop collar which may be fixedly mounted on a liner or other tubular member. The stop collar includes a first sleeve and a second sleeve. The sleeves are adapted to extend around the outer circumference of the tubular member and are engaged by threaded connections. The sleeves provide opposing inner thrust surfaces. The collar further comprises a radially expandable gripping member disposed between the opposing thrust surfaces. The sleeves may be drawn together by rotation about the threaded connection to cause the thrust surfaces to bear on the gripping member and expand the gripping member radially inward into frictional engagement with the tubular member.

US 2007/0284037 discloses a stop collar for securing a centralizer in place on a large diameter easing segment comprises a collar adapted for forming an annular chamber when received onto a casing segment. The stop collar is adapted for receiving and retaining a liquid gel epoxy adhesive in the annular chamber until the epoxy sets or cures to secure the stop collar in place on the casing.

US 2012/0073834 discloses a friction-enhancing material is applied to an outer surface of a swellable element of a downhole tool. The friction-enhancing material helps prevent axial extrusion of the elastomer of the swellable element. The friction-enhancing material may include particles, a mesh, and wickers, among other kinds of friction-enhancing material, and may be disposed on or embedded in all or a portion of an outer surface of the swellable element.

US 2020/0109607 discloses a stop collar for mounting to a downhole tubular including: a cylindrical housing having a threaded inner surface and a tapered inner surface; a compressible slip ring having teeth formed in an inner surface thereof and a pair of tapered outer surfaces; a compressible cam ring having a tapered inner surface; and a cylindrical bolt having a threaded outer surface. A natural outer diameter of each ring is greater than a minor diameter of the threaded surfaces. Screwing the threaded surfaces of the housing and the bolt is operable to drive the tapered surfaces together, thereby compressing the slip ring such that the teeth engage a periphery of the tubular.

US 2021/0285292 discloses a stop collar for mounting to a downhole tubular including: a cylindrical housing having a threaded inner surface and a tapered inner surface; a compressible slip ring having teeth formed in an inner surface thereof and a pair of tapered outer surfaces; a solid cam ring having a tapered inner surface; and a cylindrical bolt having a threaded outer surface. A natural outer diameter of each ring is greater than a minor diameter of the threaded surfaces. Screwing the threaded surfaces of the housing and the bolt is operable to drive the tapered surfaces together, thereby compressing the slip ring such that the teeth engage a periphery of the tubular The article entitled "Cement Seal Units Eliminates the inter-zonal communication" published Dec. 29, 2014 on the website egyptoil-gas.com discloses a cement seal unit two opposing cup-type "sealing elements" held in place and reinforced by two steel "back-up rings and a center "spacer band". The inner and outer "lips" of each "sealing element" provide a mechanical seal between the pipe surface and the hardened cement surrounding it. As a pressure differential develops at the casing cement interface it causes the "cupped" inner section of the opposing "sealing element" to expand and seal.

The Micro-Seal™ System-Unit (MSIS-U) brochure and Micro-Seal™ Isolation System-Bow (MSIS-B) brochure, each having a copyright date of 2009-2011 and published on the website weatherford.com disclose a swellable Micro-Seal isolation unit designed to swell in micro-annular spaces that may form during the life of the well.

The Flint-Coat brochure having a copyright date of 2021 and published on the website zerocor.com discloses a flint reinforced epoxy coating used for external casing and tubing applications. The high temperature resin is embedded with flint particles to create an extremely rough and hard surface.

SUMMARY OF THE DISCLOSURE

The present disclosure generally relates to a slimline stop collar with a seal to prevent micro-annulus leakage. In one embodiment, a stop collar for mounting to a downhole tubular includes: a cylindrical housing having a threaded inner surface and a tapered inner surface; a compressible slip ring having teeth formed in an inner surface thereof and a pair of tapered outer surfaces; a cam ring having a tapered inner surface; a seal receivable in the housing; a cylindrical bolt having a threaded outer surface. A natural outer diameter of each ring is greater than a minor diameter of the threaded surfaces. Screwing the threaded surfaces of the housing and the bolt is operable to drive the tapered surfaces together and compress the seal, thereby compressing the slip ring such that the teeth engage a periphery of the tubular and energizing the seal into engagement with the periphery of the tubular.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
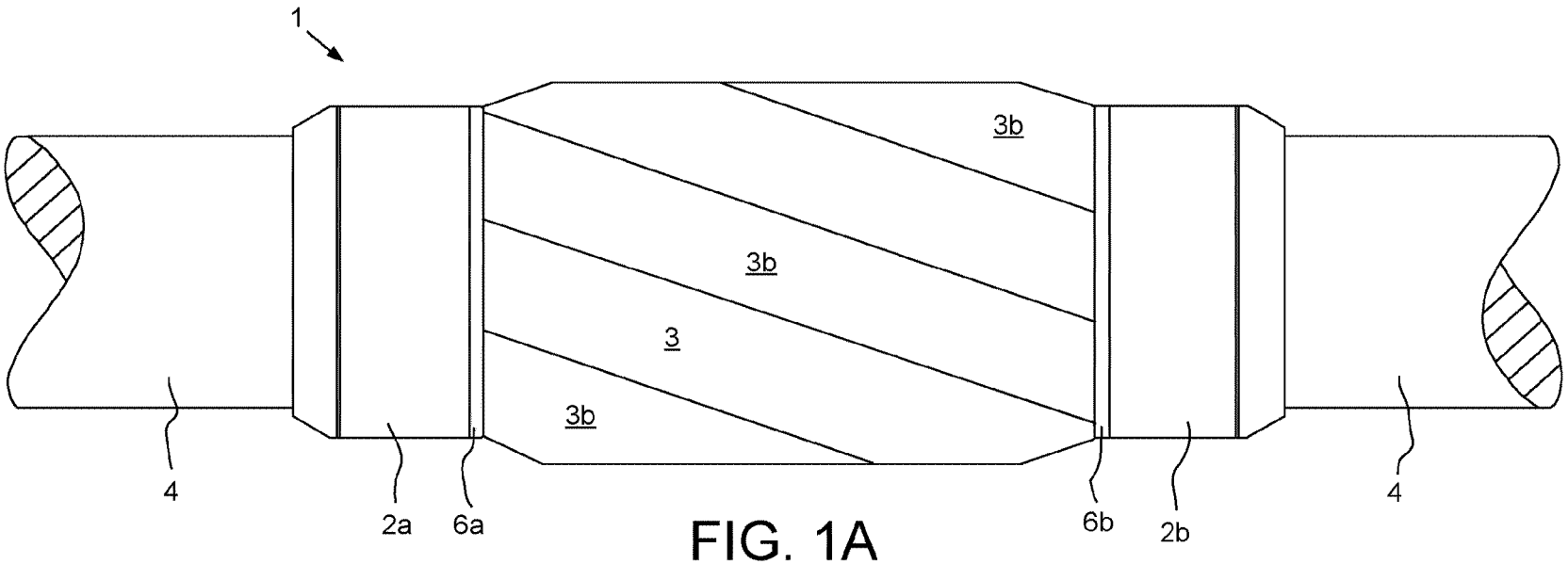
FIG. 1A illustrates a centralizer equipped with a pair of the slimline stop collars, according to one embodiment of the present disclosure.
Figure 1B:
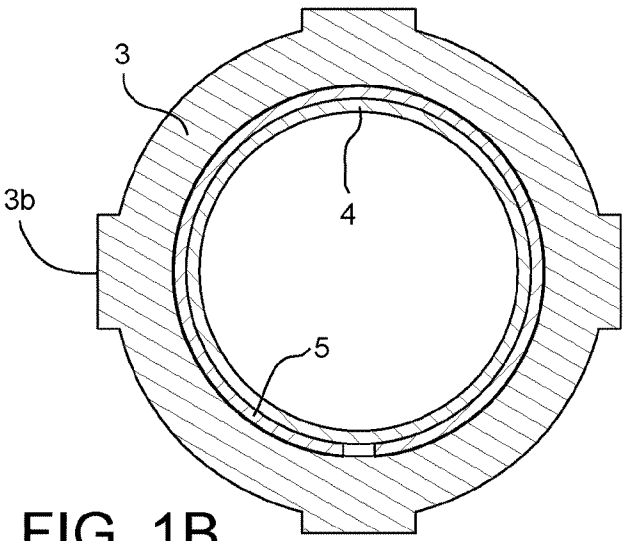
FIG. 1B illustrates a body of the centralizer mounted to a downhole tubular.

FIG. 1A illustrates a centralizer 1 equipped with a pair of the slimline stop collars 2*a,b*, according to one embodiment of the present disclosure. FIG. 1B illustrates a body 3 of the centralizer 1 mounted to a downhole tubular 4. The centralizer 1 may include the pair of slimline stop collars 2*a,b*, the body 3, a radial bearing 5, and a pair of thrust bearings 6*a,b*. Each stop collar 2*a,b* may be mounted to a downhole tubular 4, such as casing or liner, and the stop collars may straddle the centralizer 3, thereby trapping the centralizer onto the downhole tubular. The body 3 may be cylindrical and have a plurality (four shown) of blades 3*b* forming a periphery thereof and extending helically there-along. The radial bearing 5 may be a split tube made from one or more materials, such as an inner material and an outer material. The inner material of the radial bearing 5 may be a friction material and a natural inner diameter of the radial bearing may be less than an outer diameter of the downhole tubular 4, thereby forming an interference fit therewith. The outer material of the radial bearing 5 may be a low-friction material to facilitate rotation of the downhole tubular 4 relative to the body 3. An inner portion of the body 3 may also be coated with the low-friction material. Each thrust bearing 6*a,b* may be made from the low-friction material and may be disposed between the radial bearing 5 and a respective stop collar 2*a,b* or between the body 3 and the respective stop collar.

Alternatively, the radial bearing 5 may be a non-split tube. Alternatively, the radial bearing 5 may be made entirely from the low friction material.

A plurality of the centralizers 1 may each be mounted along a string of downhole tubulars 4, such as a casing or liner string, that will be drilled into a wellbore (not shown) adjacent to an unstable or depleted formation. The centralizers 1 may be spaced along the portion of the string of downhole tubulars 4 at regular intervals. Drilling the string of downhole tubulars 4 into the wellbore adjacent to the unstable or depleted formation is advantageous to using a drill string to prevent collapse or loss of drilling fluid due to the unstable or depleted formation. The string of downhole tubulars 4 may further include a casing bit screwed in at a bottom thereof and may be rotated by a top drive during drilling either directly or via a work string of drill pipe extending from the top of the string of downhole tubulars 4 to the top drive. During drilling, drilling fluid, such as mud, may be pumped down a bore of the string of downhole tubulars 4, may be discharged from the casing bit, and may return to surface via an annulus formed between the string of downhole tubulars 4 and the wellbore. The string of downhole tubulars 4 may have premium connections to withstand drilling torque exerted thereon by the top drive. The string of downhole tubulars 4 may further include a float collar located adjacent to the casing bit and a deployment assembly located at an upper end thereof including a hanger, a packer, and one or more wiper plugs. Once the string of downhole tubulars 4 has been drilled into place, the hanger may be set, cement slurry may be pumped into the annulus, and the packer set, thereby installing the string of downhole tubulars into the wellbore. The casing bit may then be drilled through to facilitate further drilling of the wellbore to a hydrocarbon bearing formation, such as crude oil and/or natural gas.

Figure 1C:
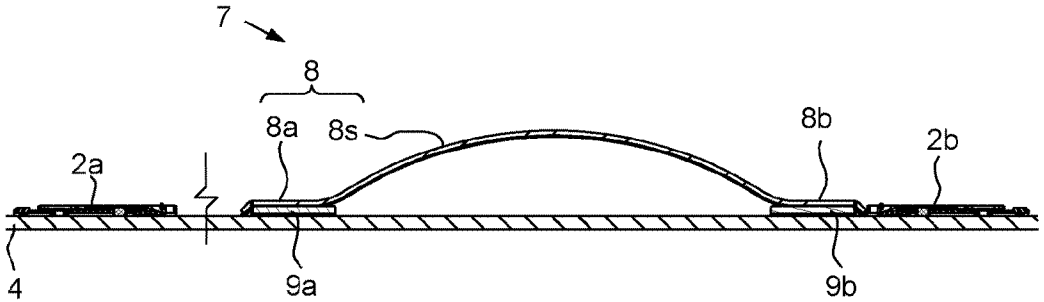
FIG. 1C illustrates the pair of the slimline stop collars being used with a resilient centralizer instead of the (rigid) centralizer, according to another embodiment of the present disclosure.

FIG. 1C illustrates the pair of the slimline stop collars 2*a,b* being used with a resilient centralizer 7 instead of the (rigid) centralizer 1, according to another embodiment of the present disclosure. The resilient centralizer 7 may include a pair of end collars 9*a,b*, a body 8, and the slimline stop collars 2*a,b*. The body 8 may have a pair of end rings 8*a,b* and a plurality of bow springs 8*s* extending therebetween. The bow springs 8*s* may be spaced around the body 8 at regular intervals, such as eight bow springs spaced at forty-five degree intervals. Bypass passages may be formed between the bow springs 8*s* to accommodate fluid flow through an annulus formed between the downhole tubular 4 and the wellbore. The bow springs 8*s* may each be identical and radially movable between an expanded position (shown) and a retracted position (not shown). The bow springs 8*s* may have a parabolic shape in the expanded position.

The body 8 may longitudinally extend when moving from the expanded position to the retracted position and longitudinally contract when moving from the retracted position to the expanded position. The bow springs 8*s* may be naturally biased toward the expanded position and an expanded diameter of the centralizer 7 may correspond to a diameter of the wellbore. Engagement of the bow springs 8*s* with a wall of the wellbore may move the downhole tubular 4 toward a central position within the wellbore to ensure that a uniform cement sheath is formed around the downhole tubular during the cementing operation. The body 8 may be formed from a single sheet of spring steel by cutting out slots to form strips which will become the bow springs 8*s*. The body 8 may be formed into a tubular shape by rolling the cut sheet and welding seams of the end rings 8*a,b* together. The bow springs 8*s* may have the natural bias toward the expanded position by being held therein during heat treatment of the body 8.

After the body 8 has been formed, each end collar 9*a,b* may be inserted into the respective end rings 8*a,b*. Each end collar 9*a,b* may be formed to be a tight fit within the end rings 8*a,b*. Each end collar 9*a,b* may then be spot-welded to the respective end rings 8*a,b*. A lip of each end ring 8*a,b* extending past the respective collar 9*a,b* may be split into a multitude of tabs (before or after insertion of the collars) and the tabs may be bent over the respective end collar, thereby mounting the collars to the body 8 (in addition to the spot welds). The pair of stop collars 2*a,b* may straddle the body 8 and end collars 9*a,b* with appropriate spacing therebetween, thereby trapping the centralizer 7 into place along the downhole tubular 4 while allowing limited longitudinal movement of the body 8 relative thereto to accommodate movement between the positions.

Alternatively, a single one of the stop collars 2*a,b* may be located between the end collars 9*a,b* by insertion through one of the slots between the bow springs 8*s* before the centralizer 7 is slid over the periphery of the downhole tubular 4.

Figure 2:
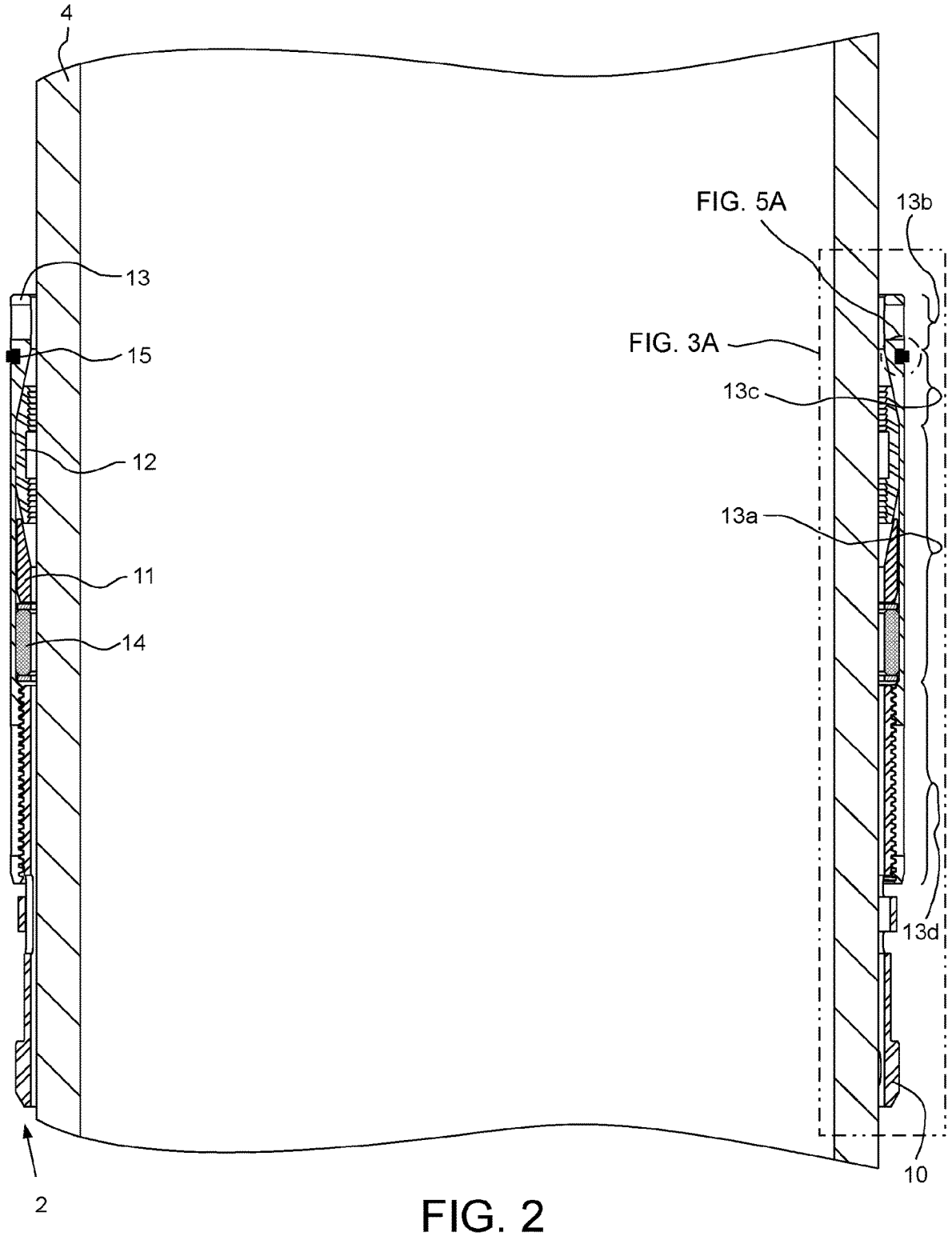
FIG. 2 illustrates a typical one of the assembled slimline stop collars in a disengaged position.
Figure 3A:
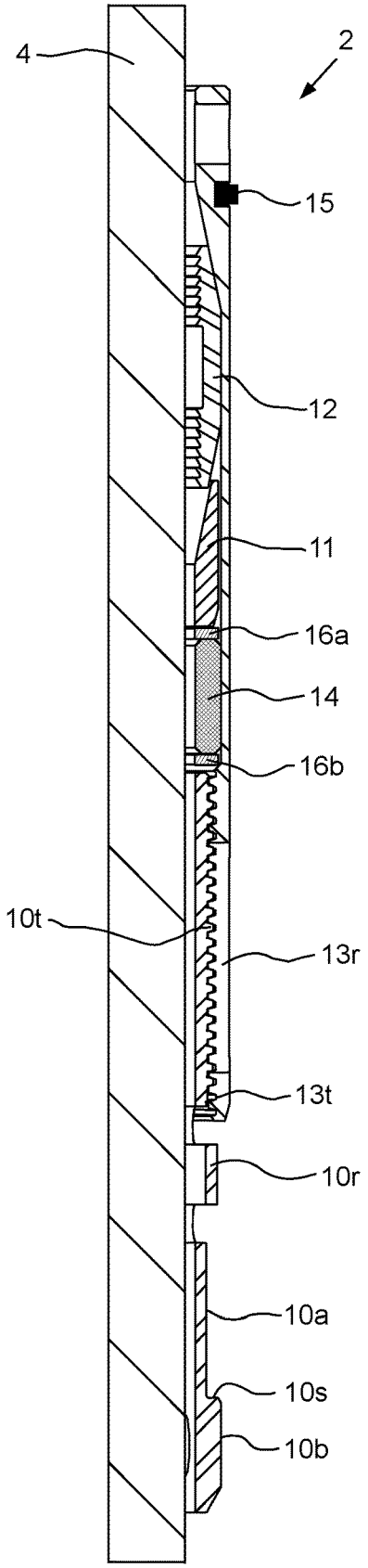
FIG. 3A is an enlargement of a portion of FIG. 2.
Figure 5A:
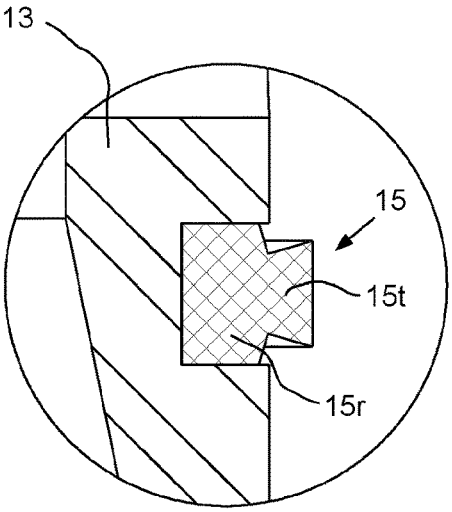
FIG. 5A is an enlargement of a portion of FIG. 2.

FIG. 2 illustrates a typical one 2 of the assembled slimline stop collars 2*a,b* in a disengaged position. FIG. 3A is an enlargement of a portion of FIG. 2. FIG. 5A is an enlargement of a portion of FIG. 2. The typical stop collar 2 may include a bolt 10, a solid cam ring 11, a slip ring 12, a housing 13, an internal seal 14, an external seal 15, and a locking system. The typical stop collar 2 may further include one or more, such as a pair, of washers 16*a,b* straddling the internal seal 14. Each of the bolt 10, cam ring 11, slip ring 12, housing 13, and washers 16*a,b* may be made from a metal or alloy, such as steel. The locking system may include a ratchet profile 13*r* of the housing 13 and a ratchet profile 10*r* of the bolt 10.

The housing 13 may be cylindrical and have a first portion 13*a* with an enlarged inner diameter for receiving the internal seal 14, the slip ring 12, and the cam ring 11, a second portion 13*b* with a reduced inner diameter for engagement with one of the thrust bearings 6*a,b* or the end collars 9*a,b*, a third portion 13*c* with a tapered inner surface connecting the first and second portions, and a fourth portion 13*d* having a threaded 13*t* inner surface partially split by the ratchet profile 13*r*, extending from an end of the housing to the first portion, and having the ratchet profile along a portion thereof. The ratchet profile 13*r* may include a series of circumferentially spaced and longitudinally extending catches, such as slots, for receiving the tabs of the ratchet profile 10*r* of the bolt 10. A more detailed view of the locking system may be found in U.S Pat Pub. App. No. 2021/0285292, which is herein incorporated by reference in its entirety to the extent that it does not conflict with the teaching herein. The inner diameters of the first portion 13*a* and second portion 13*b* may each be constant. The housing 13 may also have a plurality of holes formed through a wall of the second portion 13*b* for facilitating assembly (discussed below). The inner thread 13*t* of the fourth portion 13*d* may be for mating with a threaded surface 10*t* of the bolt 10. The forms of the threads 13*t*, 10*t* may be lead screws for driving engagement of the slip ring 12 with a periphery of the downhole tubular 4. The taper angle of the third portion 13*c* relative to an axis parallel to a longitudinal axis of the downhole tubular 4 may range between five and twenty-five degrees.

Figure 3B:
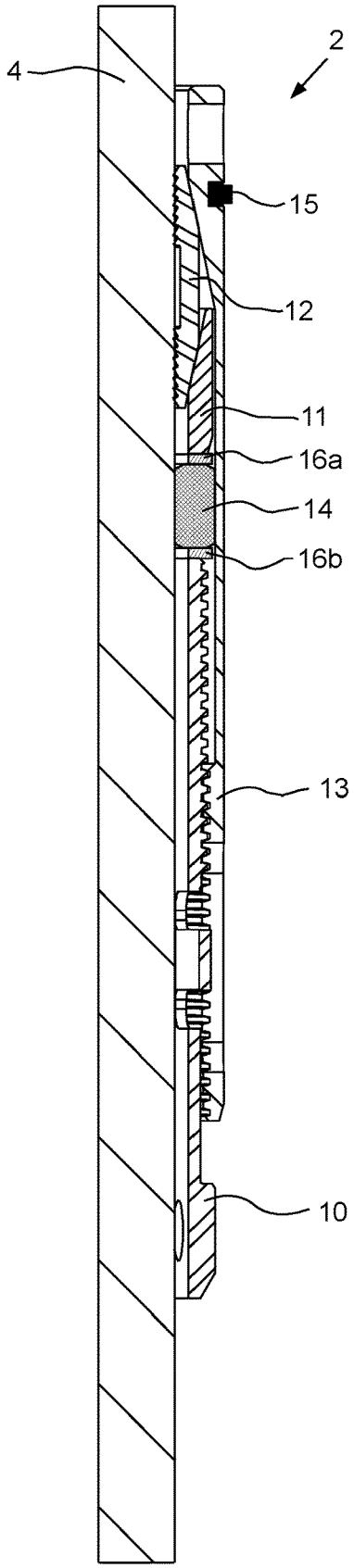
FIG. 3B illustrates the typical slimline stop collar engaged with the downhole tubular.

The slip ring 12 may have a central portion with a constant diameter outer surface and a pair of working portions, each working portion having a tapered outer surface declining away from the central portion. The taper of each working portion may correspond to the taper of the third portion 13*c* of the housing 13. An inner surface of each working portion may have a plurality of circumferential teeth (aka wickers) formed therein. Each tooth may have a cross sectional shape resembling a right triangle and the hypotenuses of the teeth of each working portion may incline toward the central portion, thereby providing bidirectional gripping of the downhole tubular 4. The slip ring 12 may be split (aka C-shape) for compression between a natural position (shown) and a compressed position (FIG. 3B). In the natural position, an outer diameter of the central portion may be greater than a minor diameter of the threads 13*t*, 10*t* and about equal (plus or minus ten percent) to the inner diameter of the first portion 13*a* of the housing 13.

Alternatively, the slip ring 12 may be partially split by a plurality of slots extending radially through a wall thereof, each slot extending from one end of the slip ring, along the respective working portion and the center portion, and terminating in the other working portion before reaching the other end of the slip ring. Alternatively, the teeth of the slip ring 12 may all be inclined in the same direction, thereby providing only monodirectional gripping of the downhole tubular 4 and the slip ring may have an orientation indicator, such as an arrow, on a periphery thereof, such as by adhering, engraving, or painting. Alternatively, the teeth of the slip ring 12 may all be inclined away from the central portion.

The solid cam ring 11 may have a first portion with a tapered inner surface for engagement with one of the working portions of the slip ring 12 and a second portion with a reduced inner diameter for engagement with an end of the bolt 10. The solid cam ring 11 may have a constant outer diameter (excluding a chamfer formed at each end thereof). The taper of the first portion may correspond to the taper of the working portions of the slip ring 12. By solid, it is meant that the cam ring has a solid wall (no slots) and is not split. The metal or alloy of the cam ring 11 may possess sufficient resilience to allow elastic compression of the cam ring between a natural position (shown) and a compressed position (not shown). In the natural position, the outer diameter of the cam ring 11 may be greater than a minor diameter of the threads 13*t*, 10*t* and less than or equal to the inner diameter of the first portion 13*a* of the housing 13.

Alternatively, the cam ring 11 may be split instead of solid, such as being C-shape) or be partially split by a plurality of slots extending radially through a wall thereof.

Each of the seals 14,15 may be made from an elastomeric material, such as an elastomer or elastomeric copolymer. Each seal 14, 15 may be a solid ring. The internal seal 14 may have a rectangular cross-section with chamfers instead of corners. The internal seal 14 may be disposed between the solid cam ring 11 and the bolt 10. The internal seal 14 may have a natural position (shown) and may be energized by longitudinal compression to an active position (FIG. 3B). In the natural position, the outer diameter of the internal seal 14 may be greater than a minor diameter of the threads 13*t*, 10*t* and less than or equal to the inner diameter of the first portion 13*a* of the housing 13. The washers 16*a,b* may be separate members from the internal seal 14. In the active position, the internal seal 14 may engage both the periphery of the downhole tubular 4 and the inner surface of the housing 13, thereby preventing flow through an annulus formed between the housing 13 and the downhole tubular 4.

Alternatively, the washers 16*a,b* may be bonded to the internal seal 14 by molding.

The external seal 15 may be received in a groove formed in an outer surface of the third portion 13*c* of the housing 13. The external seal 15 may have a complex cross-sectional shape including a rectangular inner portion 15*r* and a truncated triangular outer portion 15*t*. The inner portion 15*r* may be disposed in the housing groove and the outer portion 15*t* may protrude from an outer surface of the housing 13. A disjoined portion (relative to the outer portion 15*t*) of the outer surface of the inner portion 15*r* may be convex. The external seal 15 may have a natural position (shown) corresponding to the housing groove such that the external seal may be expanded for sliding along the outer surface of the housing 13 and then released to snap into the housing groove, thereby mounting the external seal to the housing.

The bolt 10 may be cylindrical and have a first portion 10*a* with a reduced outer diameter and the thread 10*t* formed in an outer surface thereof and extending from an end thereof, a second portion 10*b* with an enlarged outer diameter, the ratchet profile 10*r* formed in the first portion, and a shoulder 10*s* connecting the first and second portions. The bolt 10 may also have a plurality of holes formed through a wall of the second portion 10*b* for facilitating assembly (discussed below). The minor diameter of the threads 13*t*, 10*t* may be less than the inner diameter of the first portion 13*a* of the housing 13.

The ratchet profile 10*r* of the bolt 10 may include a circumferential row of openings and cantilevered tabs disposed in the openings and extending radially outward as the tabs extend circumferentially thereacross. The ratchet profile 10*r* may be located adjacent to the thread 10*t* and between the thread and the shoulder 10*s*. The ratchet profiles 10*r*, 13*r* may be configured such that the rotation is allowed in the tightening direction of rotation of the bolt 10 relative to the housing 13 but prevented in the loosening direction thereof. This is due to free ends of the tabs having a natural effective diameter greater than a major diameter of the threaded surface 13*t* to ensure that the tabs engage the slots of the ratchet profile 13*r*.

To begin assembly, the cam ring 11 may be rotated such that a longitudinal axis thereof is perpendicular to a longitudinal axis of the housing 13. The cam ring 11 may be compressed so that a portion of the outer diameter thereof is less than or equal to the minor diameter of the thread 13*t* of the housing 13. The compressed cam ring 11 may then be inserted through the thread 13*t* and into the bore of the first portion 13*a* of the housing 13 until the compressed cam ring engages the tapered third portion 13*c* of the housing. The compressed cam ring 11 may then again be rotated until the longitudinal axis thereof is parallel to the longitudinal axis of the housing 13. Such rotation may require some flexing of the cam ring 11. Once rotated into place, the cam ring 11 may then expand to the natural position thereof (compression is solely elastic, not plastic) and be slid along the bore of the first portion 13*a* of the housing 13 until the cam ring is adjacent to the housing thread 13*t*.

Alternatively, the cam ring 11 may be inserted into the housing 13 via the non-threaded end thereof adjacent to the second housing section 13*b* instead of the threaded end thereof adjacent to the fourth housing section 13*d*. Alternatively, the cam ring 11 may be partially deformed while being inserted into the housing 13 and at least partially deformed back towards its original shape, either prior to or during being positioned parallel to the longitudinal axis thereof (compression is partially plastic).

Once the cam ring 11 has been properly positioned within the housing 13, the slip ring 12 may be rotated such that a longitudinal axis thereof is at an acute angle to the longitudinal axis of the housing 13. The slip ring 12 may then be inserted into the non-threaded end of the housing 13 adjacent to the second housing section 13*b* until the non-inserted end of the slip ring 12 is adjacent to the non-threaded end of the housing. The slip ring 12 may then be compressed such that the non-inserted end of the slip ring may slide underneath the inner surface of the second housing section 13*b*, and the non-inserted end of the slip ring may then be so slid, thereby rotating the slip ring into place along the bore of the first housing section 13*a* and in partial engagement with the cam ring 11 and the tapered surface of the third housing section 13*c*.

Once the slip ring 12 has been properly positioned within the housing 13, a first one 16*a* of the washers 16*a,b* may be compressed so that a portion of the outer diameter thereof is less than or equal to the minor diameter of the thread 13*t* of the housing 13. The compressed first washer 16*a* may then be inserted through the thread 13*t* and into the bore of the first portion 13*a* of the housing 13 until the first washer is adjacent to the cam ring 11. The first washer 16*a* may then be released to expand to the natural position thereof. The internal seal 14 and the second washer 16*b* may then be installed into the housing 13 in a similar fashion as the first washer 16*a*.

Once the internal seal 14 (and associated washers 16*a,b*) has been properly positioned within the housing 13, the thread 10*t* of the bolt 10 may be engaged with the housing thread 13*t*. A first torque rod (not shown) may be inserted into one of the holes of the second housing section 13*b* and a second torque rod (not shown) may be inserted into one of the holes of the second bolt section 10*b*. Using the torque rods, the bolt 10 may be rotated relative to the housing 13 in a tightening direction, thereby advancing the bolt toward the housing until a threaded end of the bolt is adjacent to the cam ring 11 and the ratchet profile 10*r* of the bolt has begun engagement with the ratchet profile 13*r* of the housing 13, thereby placing the typical slimline stop collar 2 in a disengaged position. The torque rods 16*a,b* may be removed and the disengaged stop collar 2 may then be slid over the downhole tubular 4 until the non-threaded end of the housing 13 engages one of the thrust bearings 6*a,b* or end collars 9*a,b*.

FIG. 3B illustrates the typical slimline stop collar 2 engaged with the downhole tubular 4. Once the disengaged stop collar 2 has been positioned along the downhole tubular 4, the torque rods may be re-inserted and the bolt 10 may be further rotated relative to the housing 13 in the tightening direction, thereby further advancing the bolt into the housing. During continued rotation of the bolt 10 relative to the housing 13, the threaded end of the bolt may engage the second washer 16*b* and drive the washers 16*a,b*, the internal seal 14, and the cam ring 11 toward the slip ring 12. During continued rotation of the bolt 10 relative to the housing 13, the tapered first portion 11*a* of the cam ring 11 may slide over the adjacent working portion of the slip ring 12 until the mating tapered surfaces thereof engage, thereby driving the distal end surface thereof into engagement with the mating tapered surface of the third portion 13*c* of the housing. During continued rotation of the bolt 10 relative to the housing 13, the tapered first portion 11*a* of the cam ring 11 may continue to slide over the adjacent working portion of the slip ring 12 and advancement of the slip ring along the tapered inner surface of the third portion 13*c* of the housing may continue, thereby radially compressing the slip ring 12 toward the periphery of the downhole tubular 4. During continued rotation of the bolt 10 relative to the housing 13, the cam ring 11 may exert a reaction force on the first washer 16*a* while the bolt drives the second washer toward the internal seal 14, thereby longitudinally compressing the internal seal and radially expanding the internal seal into engagement with the periphery of the downhole tubular 4. Radial compression of the slip ring 12 may continue until the teeth thereof engage and penetrate the periphery of the downhole tubular 4, thereby longitudinally and torsionally mounting the stop collar 2 to the downhole tubular.

Also during continued rotation of the bolt 10 relative to the housing 13, the tabs of the ratchet profile 10*r* may engage the slots of the ratchet profile 13*r*. Since the bolt 10 is being rotated in a tightening direction, a joined end of each tab may enter and exit the respective slot before the free end of the tab, thereby allowing walls of the slot to compress the tab so that rotation in the tightening direction is not obstructed. Operation of the locking system 14 prevents rotation of the bolt 10 in the loosening direction during deployment of the centralizer 1, which could be caused by vibration. There may be some acceptable backlash until the ratchet profiles 10*r*, 13*r* engage depending on the relative positions of the bolt 10 and the housing 13 at full engagement of the slip ring 12.

Alternatively, the stop collar 2 may be installed on the downhole tubular 4 with the bolt 10 located adjacent to one of the thrust bearings 6*a,b* or end collars 9*a,b* instead of the housing 13 located adjacent thereto.

Figure 4A:
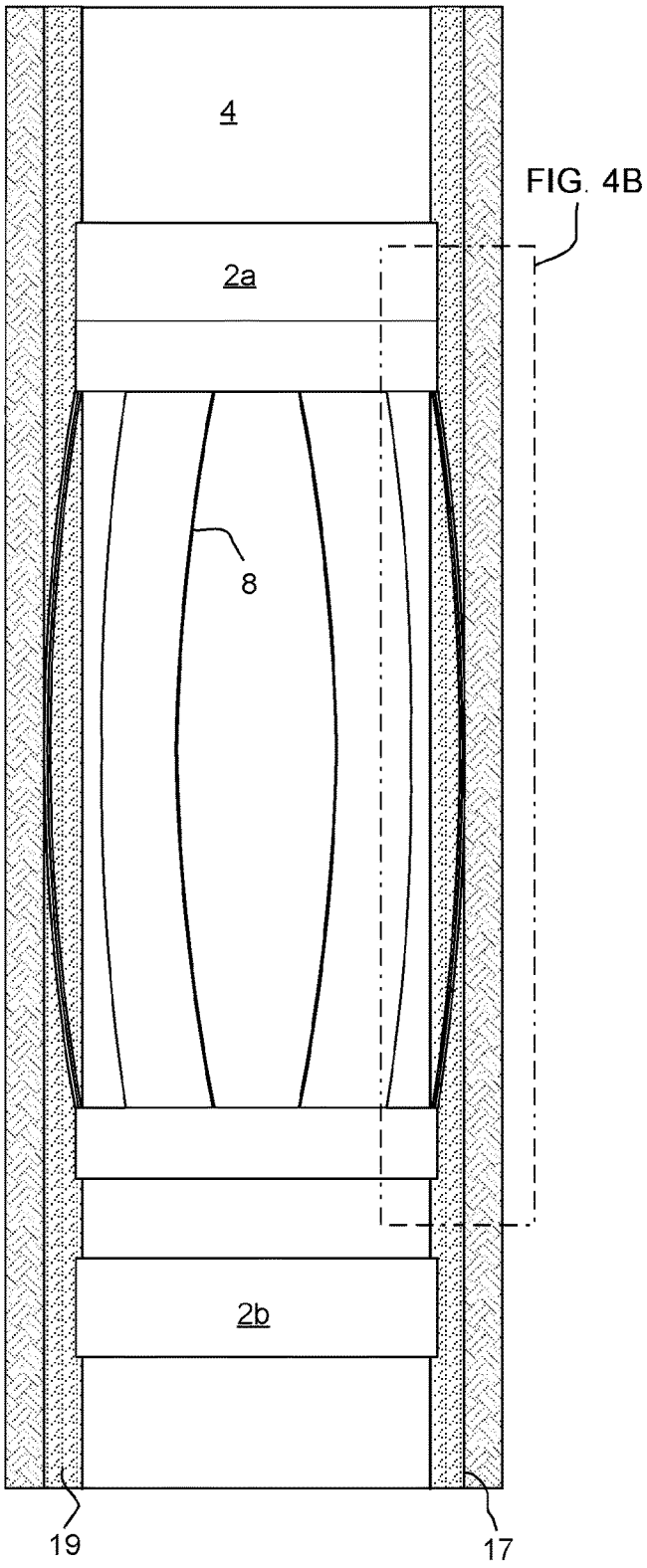
FIGS. 4A and 4B illustrate the slimline stop collars employed in a wellbore and operating to block leakage through a micro-annulus.
Figure 4B:
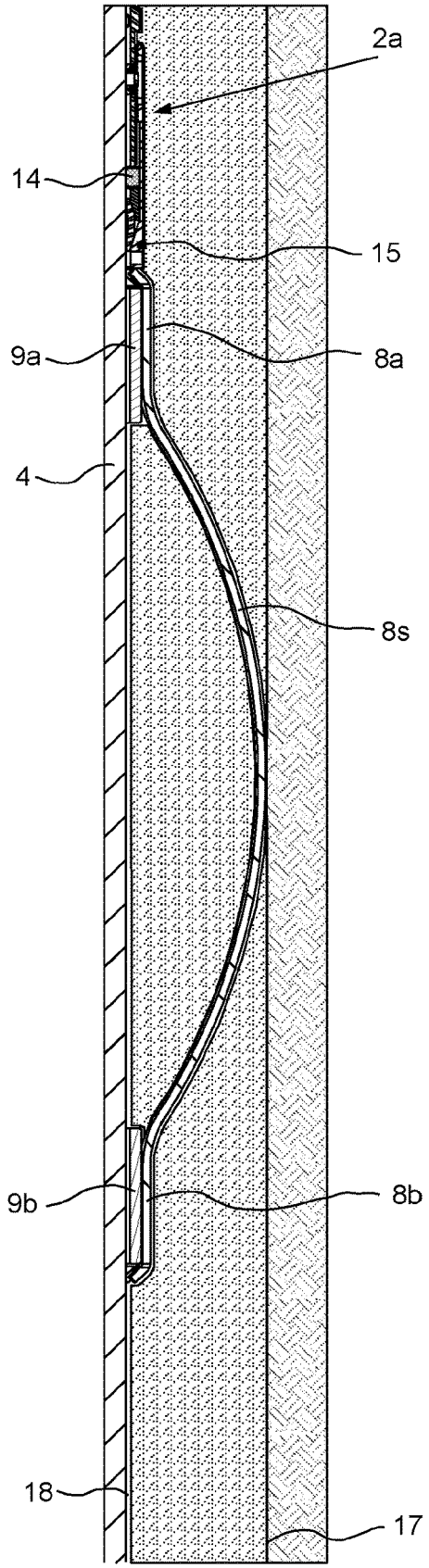

FIGS. 4A and 4B illustrate the slimline stop collars 2*a,b* employed in a wellbore 17 and operating to block leakage through a micro-annulus 18. The downhole tubular 4 equipped with a centralizer 7 has been deployed into the wellbore 17 and secured into place by a cement sheath 19. The micro-annulus 18 has formed between the cement sheath 19 and the periphery of the downhole tubular 4. The micro-annulus 18 has also formed between the cement sheath 19 and the centralizer 7. The internal seal 14 serves to block flow along the micro-annulus 18 between the cement sheath 19 and the periphery of the downhole tubular 4. The external seal 15 blocks flow along the micro-annulus 18 between the cement sheath and the housing 13.

Advantageously, the slimline stop collar(s) 2*a,b* sealing the micro-annulus 18 avoids having to equip the downhole tubular 4 with separate annular seals or a coating. Further, the internal seal 14 being mechanically energized provides absolute assurance that the micro-annulus 18 along the interface with the downhole tubular 4 will be sealed.

Figure 5B:
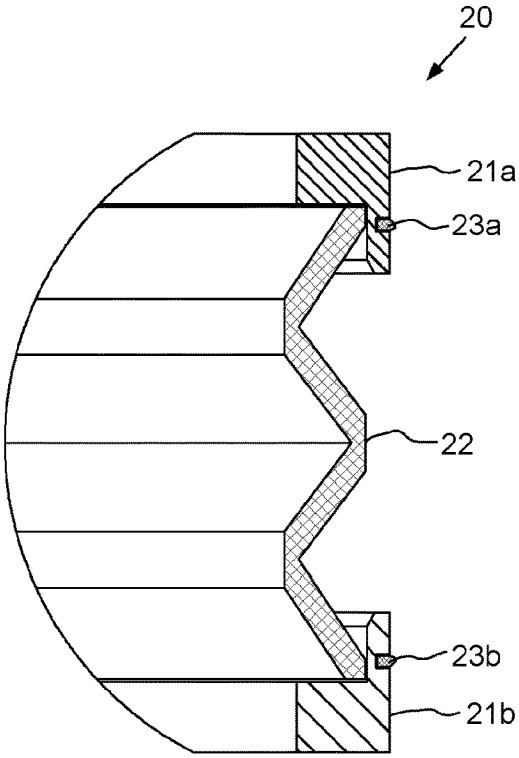
FIG. 5B illustrates an alternative internal seal for use with the typical slimline stop collar, according to another embodiment of the present disclosure.

FIG. 5B illustrates an alternative internal seal 20 for use with the typical slimline stop collar 2, according to another embodiment of the present disclosure. The alternative internal seal 20 may replace the internal seal 14 and washers 16*a,b* in the slimline stop collar 2. The alternative internal seal 20 may include a pair of glands 21*a,b*, a bellows 22, and a pair of auxiliary seal rings 23*a,b*. Each gland 21*a,b* may be made from a metal or alloy, such as a steel. Each gland 21*a,b* may be annular and carry a respective auxiliary seal ring

23*a,b* in a groove formed in an outer surface thereof. The auxiliary seal rings 23*a,b* may engage an inner surface of the housing 13, thereby sealing an interface between the housing and the glands 21*a,b*. Each of the bellows 22 and the auxiliary seal rings 23*a,b* may be made from an elastomeric material, such as an elastomer or elastomeric copolymer. Each of the glands 21*a,b* may be made from a metal or alloy, such as steel. Each gland 21*a,b* may have a reduced inner diameter leading portion extending away from the bellows 22, an enlarged inner diameter trailing portion receiving a respective end of the bellows, and a shoulder connecting the two portions. Each auxiliary seal ring 23*a,b* may be located at the respective enlarged inner diameter portion. The bellows 22 may have a natural position (shown) and may be energized into engagement with the periphery of the downhole tubular 4 by compression between the glands 21*a,b*.

Figure 5C:
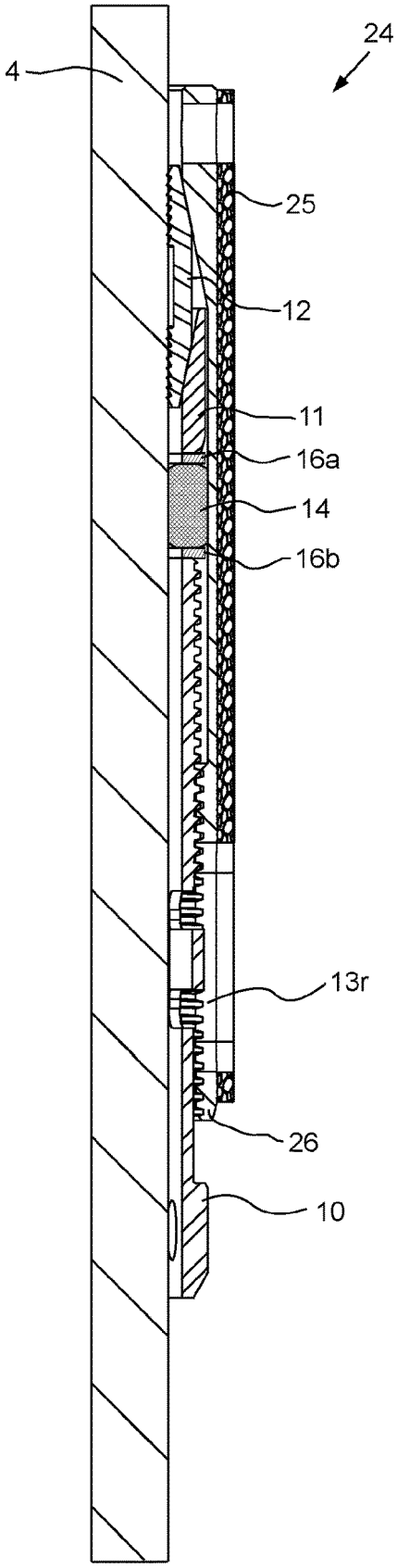
FIG. 5C illustrates an alternative slimline stop collar having an external coating instead of an external seal, according to another embodiment of the present disclosure.

FIG. 5C illustrates an alternative slimline stop collar 24 having an external coating 25 instead of the external seal 15, according to another embodiment of the present disclosure. The alternative slimline stop collar 24 may include the bolt 10, the solid cam ring 11, the slip ring 12, the external coating 25, a modified housing 26, the internal seal 14, the washers 16*a,b*, and the locking system. The modified housing 26 may be similar or identical to the housing 13 except for omission of the groove receiving the external seal 15. The coating 25 may extend along and around an outer surface of the modified housing 26. The coating 25 may be a composite material including a matrix material and an aggregate material. The matrix material may be a polymer, such as epoxy, and the aggregate may be flint. The coating 15 may improve the bond between the modified housing 25 and the cement sheath 19, thereby preventing formation of the micro-annulus 18 there-along and obviating the need for the external seal 15. The coating 25 may be interrupted at the ratchet profile 13*r* and the holes for the torque rods.

Alternatively, the portions of the modified housing 26 having the ratchet profile 13*r* and the holes for the torque rod may be uncoated. Alternatively, the coating 25 may cover the ratchet profile 13*r* of the modified housing 26. Alternatively, the modified housing 26 may have a rough surface finish, such as greater than 125 RMS to improve the bond with the cement sheath 19 instead of the coating. Alternatively, the aggregate from the coating 25 may be omitted. Alternatively, the aggregate from the coating 25 may be omitted and the matrix material may be elastomeric, such as a elastomer or elastomeric copolymer. Alternatively, the aggregate from the coating 25 may be omitted and the matrix material may be a polymer, such as a swellable polymer. Alternatively, the housing 13 and the external seal 15 may be used with the alternative slimline stop collar 24 instead of the modified housing 26 such that the coating 25 may extend from the external seal along the housing.

Figure 6A:
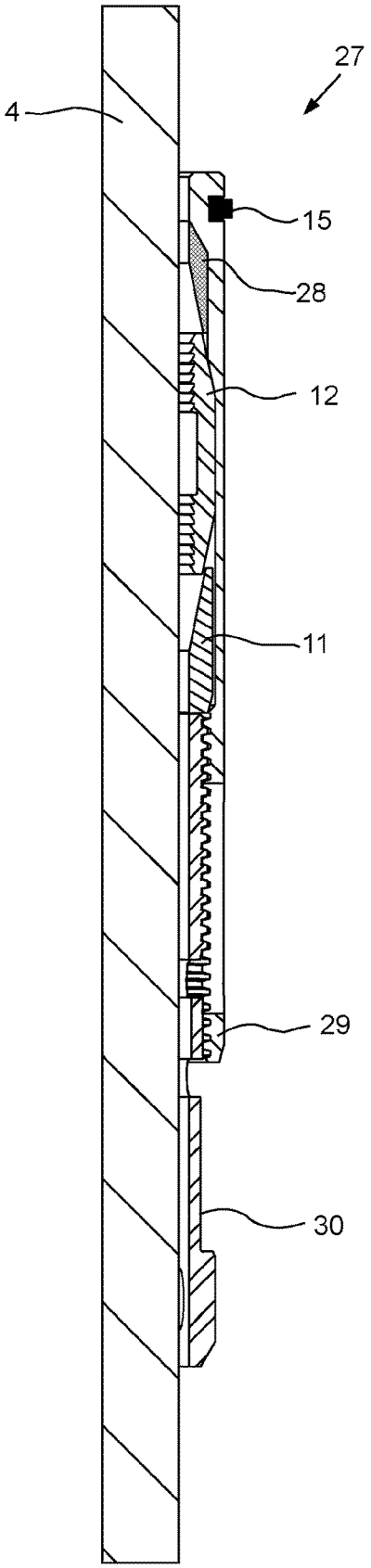
FIG. 6A illustrates a second alternative slimline stop collar having an alternative internal seal and in the disengaged position, according to another embodiment of the present disclosure.
Figure 6B:
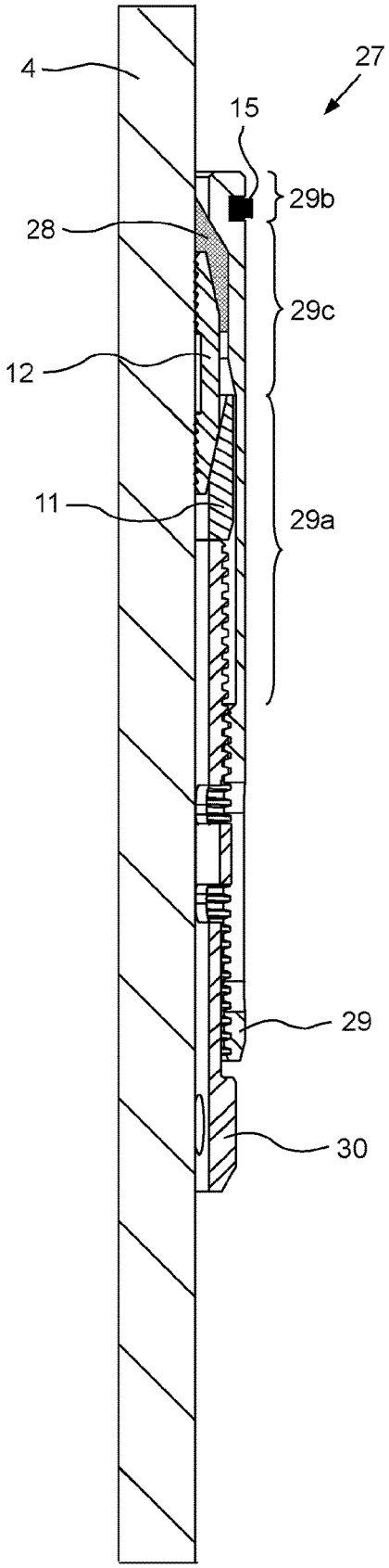
FIG. 6B illustrates the second alternative slimline stop collar engaged with the downhole tubular.

FIG. 6A illustrates a second alternative slimline stop collar 27 having an alternative internal seal 28 and in the disengaged position, according to another embodiment of the present disclosure. FIG. 6B illustrates the second alternative slimline stop collar 27 engaged with the downhole tubular 4. The second alternative slimline stop collar 27 may include a modified bolt 30, the solid cam ring 11, the slip ring 12, a modified housing 29, the alternative internal seal 28, the external seal 15, and the locking system. The modified bolt 30 may be similar or identical to the bolt 10 except for having a different length to accommodate operation of the alternative internal seal 28. The modified housing 29 may be similar or identical to the housing 13 except for having modified first through third sections 29*a-c*.

The modified first portion 29*a* of the modified housing 29 may have an enlarged inner diameter for receiving the slip ring 12 and the cam ring 11. The modified second portion 29*b* may have a reduced inner diameter for engagement with one of the thrust bearings 6*a,b* or the end collars 9*a,b*. The modified third portion 29*c* may have a first tapered inner surface extending from the modified second portion 29*b*, a second tapered inner surface extending from the modified first portion 29*a*, and a constant inner diameter surface connecting the two tapered inner surfaces. The second tapered surface of the modified third portion 29*c* may interact with the slip ring 12 and the first tapered inner surface thereof may interact with the alternative internal seal 28. The inner diameters of the modified first 29*a* and second 29*b* portions may each be constant. The groove for receiving the external seal 15 may be formed in an outer surface of the modified second portion 29*b*.

Alternatively, the modified second portion 29*b* of the modified housing 29 may be extended and may have a plurality of holes formed through a wall thereof 13*a* for facilitating assembly.

The alternative internal seal 28 may be made from an elastomeric material, such as an elastomer or elastomeric copolymer. The alternative internal seal 28 may be a solid ring. The alternative internal seal 28 may have a polygonal cross-section conforming to: the first tapered inner surface and the constant inner diameter surface of the modified third portion 29*c* of the modified housing 29; and the tapered outer surface of one of the working portions of the slip ring 12. The internal seal 14 may have a natural position (FIG. 6A) and may be energized by longitudinal compression between the slip ring 12 and the first tapered surface of the third housing portion 29*c* to an active position (FIG. 6B). In the natural position, the outer diameter of the internal seal 14 may be greater than a minor diameter of the threads 13*t*, 10*t* and less than or equal to the inner diameter of the constant inner diameter surface of the modified third portion 29*c*. In the natural position, the alternative inner seal 28 may be disposed in the modified third housing section. In the active position, the alternative internal seal 28 may engage both the periphery of the downhole tubular 4 and the inner surface of the modified housing 29, thereby preventing flow through an annulus formed between the modified housing and the downhole tubular 4. In the active position, deformation by energization of the alternative inner seal 28 may cause the alternative inner seal 28 to extend into the modified second portion 29*b*.

While the foregoing is directed to embodiments of the present disclosure, other and further embodiments of the disclosure may be devised without departing from the basic scope thereof, and the scope of the invention is determined by the claims that follow.

The invention claimed is:

1. A stop collar for mounting to a downhole tubular, comprising:

a cylindrical housing having a threaded inner surface and a tapered inner surface;

a compressible slip ring having teeth formed in an inner surface thereof and a pair of tapered outer surfaces;

a cam ring having a tapered inner surface;

a seal receivable in the housing;

a cylindrical bolt having a threaded outer surface, wherein:

a natural outer diameter of each ring is greater than a minor diameter of the threaded surfaces, and screwing the threaded surfaces of the housing and the bolt is operable to drive the tapered surfaces together and compress the seal, thereby compressing the slip ring such that the teeth engage a periphery of the tubular and energizing the seal into engagement with the periphery of the tubular.

2. The stop collar of claim 1, wherein the seal is disposed between the bolt and the cam ring.

3. The stop collar of claim 2, wherein the seal is a solid ring having a rectangular cross section.

4. The stop collar of claim 2, wherein:

the seal comprises a bellows and a pair of glands, and each glad carries an auxiliary seal ring for engaging an inner surface of the housing.

5. The stop collar of claim 1, wherein:

the tapered inner surface of the housing is a first surface, the seal is disposed between the slip ring and a second tapered inner surface of the housing.

6. The stop collar of claim 1, wherein:

the seal is an internal seal, and the stop collar further comprises an external seal disposed in a groove formed in an outer surface of the housing and protruding therefrom.

7. The stop collar of claim 1, wherein:

the housing is made from a metal or alloy, the stop collar further comprises a coating extending along and around an outer surface of the housing, and the coating is operable to improve bonding of a cement sheath with the housing.

8. The stop collar of claim 7, wherein the coating comprises a polymer matrix and an aggregate material.

9. The stop collar of claim 1, wherein:

the housing is made from a metal or alloy, and an outer surface of the housing has a surface finish rougher than 125 RMS (Root Mean Square).

* * * * *